US006889406B2

(12) United States Patent
Schmitz

(10) Patent No.: US 6,889,406 B2
(45) Date of Patent: May 10, 2005

(54) SEPARATING DEVICE FOR A TEXTILE PROCESSING MACHINE

(75) Inventor: Markus Schmitz, Mönchengladbach (DE)

(73) Assignee: Trutzchier GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/602,611

(22) Filed: Jun. 25, 2003

(65) Prior Publication Data

US 2004/0040121 A1 Mar. 4, 2004

(30) Foreign Application Priority Data

Jul. 15, 2002 (DE) ..... 102 31 829

(51) Int. Cl.[7] ..... D01G 15/76
(52) U.S. Cl. ..... 19/107; 19/104; 19/109
(58) Field of Search ..... 19/65 R, 98, 199, 19/105, 107, 108, 109, 200, 202, 203, 204, 205

(56) References Cited

U.S. PATENT DOCUMENTS

| | | | | | |
|---|---|---|---|---|---|
| 4,805,268 | A | * | 2/1989 | Leifeld | 19/105 |
| 4,969,235 | A | * | 11/1990 | Marx | 19/105 |
| 5,031,279 | A | * | 7/1991 | Temburg | 19/104 |
| 5,107,571 | A | * | 4/1992 | Marzoli et al. | 19/105 |
| 5,181,295 | A | | 1/1993 | Demuth et al. | |
| 5,241,726 | A | * | 9/1993 | Pezzoli et al. | 19/200 |
| 5,255,415 | A | | 10/1993 | Leifeld et al. | |
| 5,313,688 | A | * | 5/1994 | Leifeld et al. | 19/107 |
| 5,530,994 | A | * | 7/1996 | Loeffler | 19/109 |
| 6,145,166 | A | * | 11/2000 | Waeber et al. | 19/109 |

FOREIGN PATENT DOCUMENTS

| | | |
|---|---|---|
| DE | 37 02 588 A1 | 10/1987 |
| DE | 38 25 419 A1 | 2/1990 |
| DE | 39 02 204 A1 | 8/1990 |
| DE | 4130093 A | 3/1992 |
| DE | 41 30 147 A1 | 3/1992 |
| DE | 298 10 665 U1 | 1/1999 |
| DE | 100 50 974 A1 | 4/2002 |
| EP | 0 618 318 A1 | 10/1994 |
| EP | 1 033 424 A1 | 9/2000 |
| GB | 2 285 637 A | 7/1995 |

* cited by examiner

*Primary Examiner*—Gary L. Welch
(74) *Attorney, Agent, or Firm*—Venable LLP

(57) ABSTRACT

In a device on a spinning preparatory machines, especially a carding machine, cleaning machine or the like for cotton having at least one separating blade for impurities, which is associated with a clothed roller, for example a licker-in or the like, wherein the separating blade is arranged on a support which is displaceable parallel to (concentrically with) the periphery of the roller, the distance between the separating blade and a fixed-position counter-element bordering the separation opening is variable.

In the event of a change in the position of the separating blade, in order to provide uniform removal of impurities and uniform supply of air into an extraction chamber, the separating blade is associated with an extraction chamber which is mounted on the support, and the extraction chamber cooperates with a fixed-position guide element which is able to guide the separated impurities and/or air into the opening of the extraction chamber.

20 Claims, 3 Drawing Sheets

SEPARATING DEVICE FOR A TEXTILE PROCESSING MACHINE

CROSS REFERENCE TO RELATED APPLICATION

This application claims priority from German Patent Application No. 102 31 829.8, which is incorporated herein by reference.

BACKGROUND OF THE INVENTION

The invention relates to a device on a spinning preparatory machine, especially a carding machine, cleaning machine or the like for cotton having at least one separating blade for impurities, which is associated with a clothed roller, for example a licker-in or the like.

In a known arrangement the separating blade is arranged on a support which is displaceable parallel to (concentrically with) the periphery of the roller and wherein the distance between the separating blade and a fixed-position counter-element bordering the separation opening is variable.

In the known device of European Patent Specification No. 0 618 318, the impurities separated by the separating blade fall downwards into the space below the roller and have to be removed from there. Removal is complicated and can result in the machine becoming blocked. A further disadvantage is that the impurities fall diffusely and therefore the entire lower machine space has to be cleaned. As a result, the impurities and the air currents are swirled about.

SUMMARY OF THE INVENTION

It is an aim of the invention to provide a device of the kind mentioned at the beginning which avoids or mitigates the mentioned disadvantages and which allows uniform removal of impurities and uniform supplying of air into the extraction chamber, especially when the position of the separating blade is varied.

The invention provides a device on a spinning preparatory machine having at least one separating blade which is associated with a roller and co-operates with a fixed position counter element to define a separation opening for impurities, wherein the separating blade is arranged on a support which is displaceable substantially parallel to the periphery of the roller for adjusting the distance between the separating blade and the fixed-position counter-element, the device further comprises an extraction chamber which is mounted on the support, and the extraction chamber co-operates with a guide element, the guide element being arranged to be in a fixed position during operation of the machine and being able to guide separated impurities and/or air into the opening of the extraction chamber.

The movable extraction hood cooperates with a fixed-position guide element and, as a result, the separated impurities and/or the intake air can be guided uniformly into the extraction hood. In this way, when the positions of the blade and the extraction hood are changed, advantageously a substantially constant amount of air is sucked into the extraction hood and the impurities (waste) are prevented from falling past the extraction hood. The provision of constant amounts of air and constant flow speeds for supplying the extraction hood with air is in particular possible where, as is preferred, the fixed-position guide element cooperates with the movable extraction hood in the manner of a nested arrangement.

Advantageously, the distance between the guide element and a fixed position counter-element is substantially constant. Advantageously, the distance between the guide element and the fixed position counter-element has a free end, which may decrease in thickness. Advantageously, the free end is oriented in the direction of the intake opening (intake slot). The guide element may have at least one rounded edge over its width. The guide sheet may have a free end. The guide sheet may have a curved guide surface. Advantageously, the distance of the guide element from the roller is less than the distance of the guide sheet. Advantageously, the guide element co-operates with the guide sheet. The guide sheet may be arranged substantially underneath the guide element with respect to the roller. The guide sheet may be displaced with respect to the fixed-position guide element. Advantageously, the displacement is effected in a parallel direction. Advantageously, the radii of curvature of the rear side surface of the guide element and of the guide surface of the guide sheet are the same. The guide element and the guide sheet are advantageously nested with one another. The extraction chamber may be mounted separately on the support. The extraction chamber may be mounted releasably on the support. Advantageously, the width of the intake opening is approximately 15 to 25 mm. Advantageously, the end face of the extraction chamber is adjoined by an extraction line, which may be connected to at least one suction source. Advantageously, the position of the support can be adjusted by means of an adjusting device. The adjusting device may be manually operable. The adjusting device may be motor-operable. The support may be associated with a mechanical adjusting device, for example, a rack having a curved tooth bar which co-operate with a pinion. The adjusting device may have a driven reversing gear. Advantageously, the fixed position guide element is associated with an adjusting and fixing device. Advantageously, there is a continuous opening between the guide element of air. Advantageously, supplied air can be taken in through the opening. Advantageously, the supplied air assists the transport of impurities.

The invention also provides a device on a carding machine, cleaning machine or the like for cotton having at least one separating blade for impurities, which is associated with a clothed roller, for example a licker-in or the like, wherein the separating blade is arranged on a support which is displaceable parallel to (concentrically with) the periphery of the roller and wherein the distance between the separating blade and a fixed-position counter-element bordering the separation opening is variable, in which the separating blade is associated with an extraction chamber which is mounted on the support, and the extraction chamber co-operates with a fixed-position guide element which is able to guide the separated impurities and/or air into the opening of the extraction chamber.

Furthermore, the invention provides a method of removing impurities from textile fibre material at a roller, comprising withdrawing the impurities from the vicinity of the roller through a separation opening having a separation blade, adjusting the position of the separation blade to adjust the size of the separation opening and guiding the impurities into an extraction chamber by means of a guide element.

DESCRIPTION OF THE PREFERRED EMBODIMENTS

Figure 1:
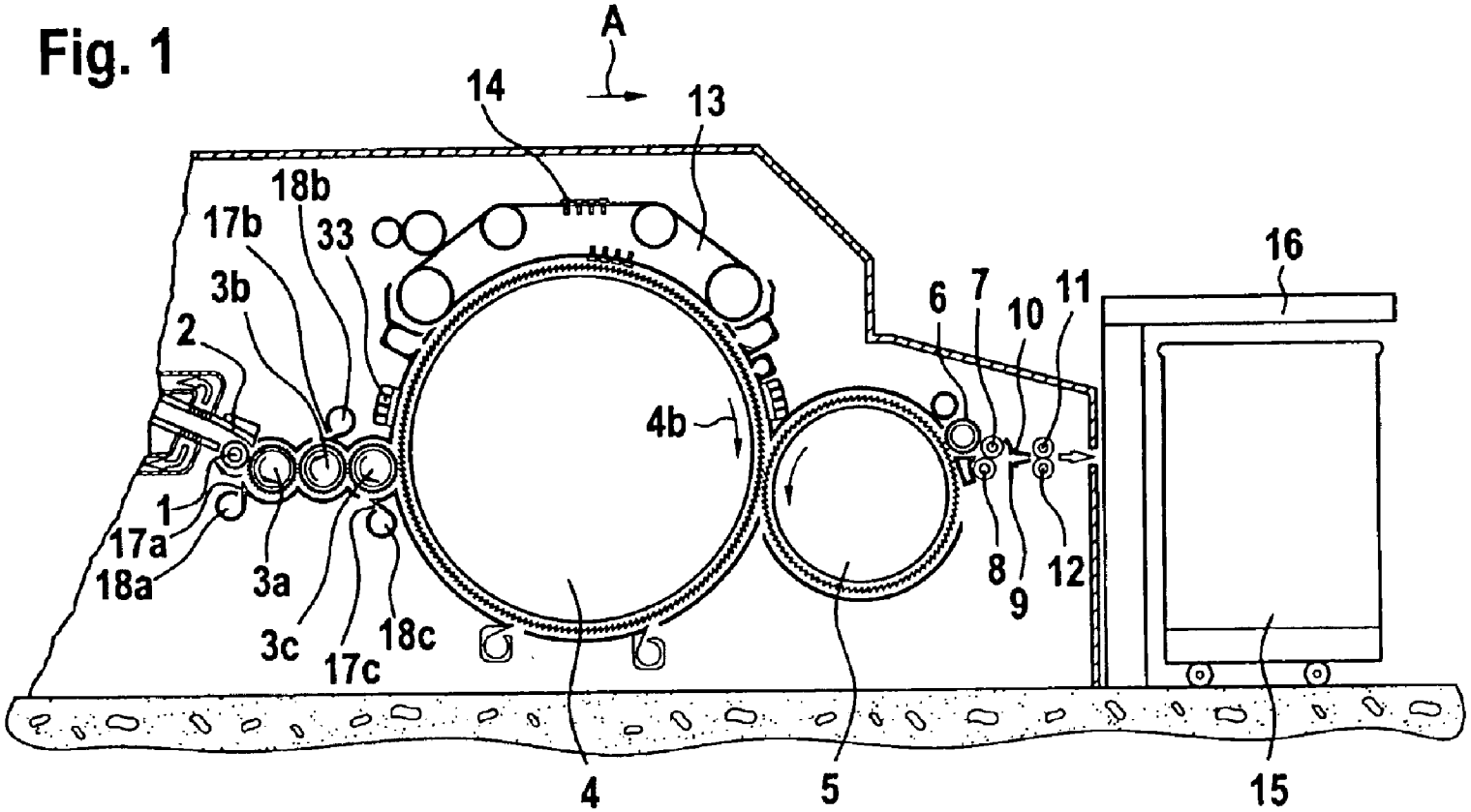
FIG. 1 is a diagrammatic side view of a carding machine having a device according to the invention.

With reference to FIG. 1, a carding machine, for example a high performance carding machine DK 903 (trade mark) made by Trützschler GmbH & Co. KG, having a feed roller 1, feed table 2, lickers-in 3*a*, 3*b*, 3*c*, cylinder 4, doffer 5, stripper roller 6, nip rollers 7, 8, web guide element 9, sliver funnel 10, delivery rollers 11, 12, revolving card top 13 with clothed card top bars 14, can 15 and coiler 16. The directions of rotation of the rollers are indicated by curved arrows. Reference letter A denotes the operating direction. The lickers-in 3*a*, 3*b* and 3*c* are each associated with a separating blade 17*a*, 17*b* and 17*c*, respectively, having extraction hoods 18*a*, 18*b*, 18*c*. In the region of the extraction chambers 18*a*, 18*b*, 18*c* there are arranged as described below with reference to FIGS. 3*a*, 3*b*, guide elements 19*a*, 19*b* and 19*c*, respectively. The separating blades 17*a*, 17*b* and 17*c* and the extraction hoods 18*a*, 18*b* and 18*c* are each arranged on a respective displaceable support 20*a*, 20*b* and 20*c*, (see FIGS. 3*a*, 3*b* showing blade 17*a* and hood 18*a* arranged on support 20*a*).

Figure 2:
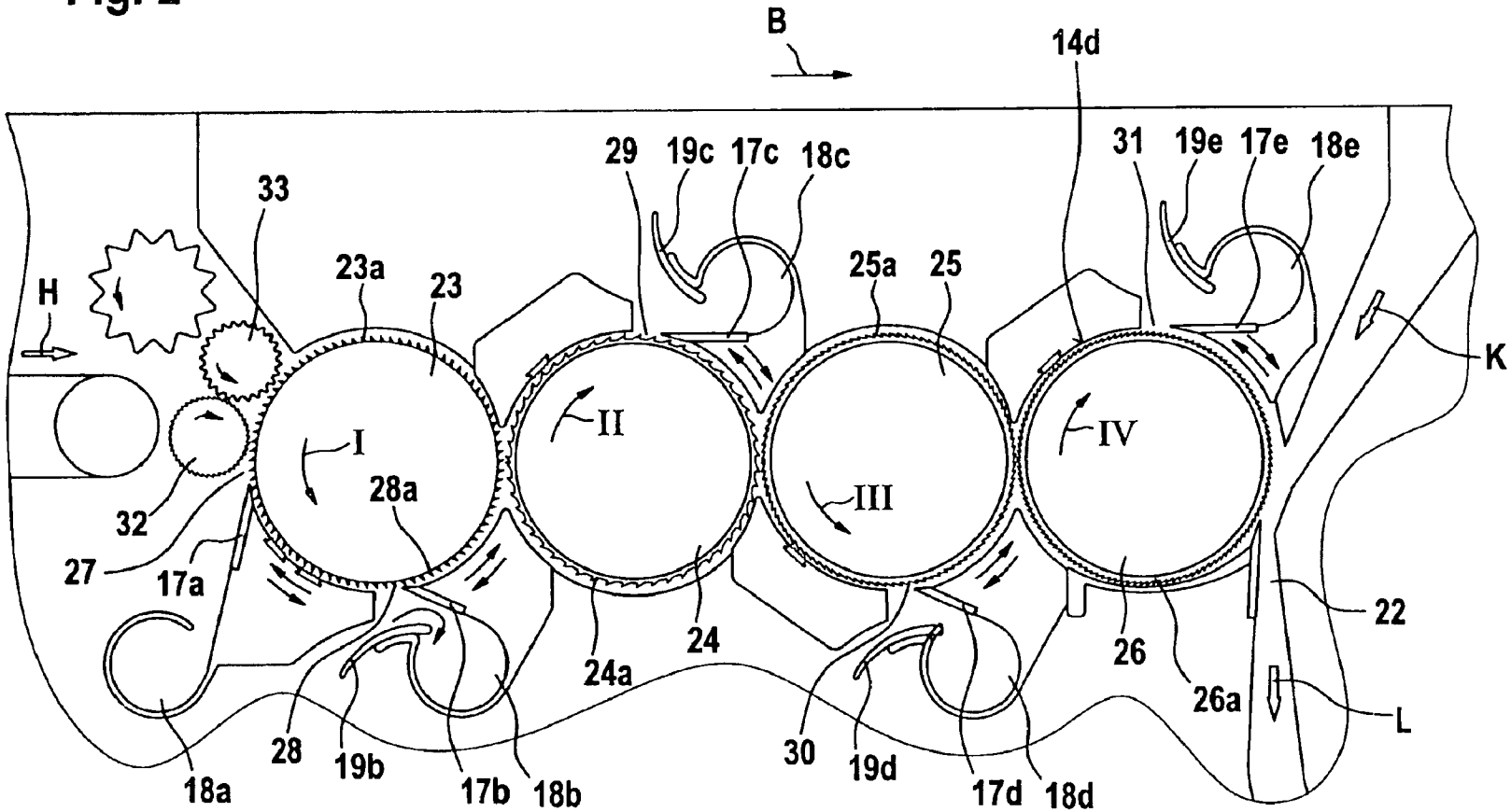
FIG. 2 is a diagrammatic side view of a cleaner having a device according to the invention.

Referring to FIG. 2, a cleaning device, which is arranged in a closed housing, is supplied with the fibre material to be cleaned (arrow H), which is especially cotton, in flock form. This is effected, for example, by a filling chute (not shown), by a conveyor belt or the like. The lap is supplied by means of two feed rollers 32, 33 under the clamping action of a pinned roller 23, having pins 23*a*, which is rotatably mounted in the housing and rotates anticlockwise. Downstream of the pinned roller 23 there is arranged a clothed roller 24 which is covered with sawtooth clothing 24*a*. The roller 23 has a circumferential speed of about from 10 to 21 m/sec. The roller 24 has a circumferential speed of about from 15 to 25 m/sec. The direction of rotation of each of rollers 23, 24 is indicated by arrows I, II, respectively. Downstream of the rollers 23 and 24 there are arranged one after the other two further sawtooth rollers 25 and 26, the directions of rotation of which are indicated by III and IV, respectively. The rollers 25, 26, have sawtooth surfaces 25*a*, 26*a*. The rollers 23 to 26 have a diameter of about from 150 to 300 mm. The pinned roller 23 is enclosed by the housing. The pinned roller 23 is associated with a separation opening 27 for discharging fibre impurities, the size of which is matched or is matchable to the degree of contamination of the cotton. The separation opening 27 is associated with a separating edge 17*a*, for example a blade. In the direction of arrow I there are present at the roller 23 a further separation opening 28 and a separating edge 17*b*. The sawtooth roller 24 is associated with a separation opening 29 and a separating edge 17*c*; the sawtooth roller 25 is associated with a separation opening 30 and a separating edge 17*d*; and the sawtooth roller 26 is associated with a separation opening 31 and a separating edge 17*e*. Each separating blade 17*a* to 17*e* is associated with an extraction hood 18*a* to 18*e*. Reference letter B denotes the operating direction of the cleaner. Each extraction hood 18*a* to 18*e* is associated with a guide element 19*a* to 19*e*. Reference letter I denotes the air current containing impurities F, which enters the extraction hood 18*b*. Reference numeral 28A denotes a portion of the housing. Downstream of roller 26 is a conduit 22 for taking away fibre material ejected from roller 26.

Figure 3A:
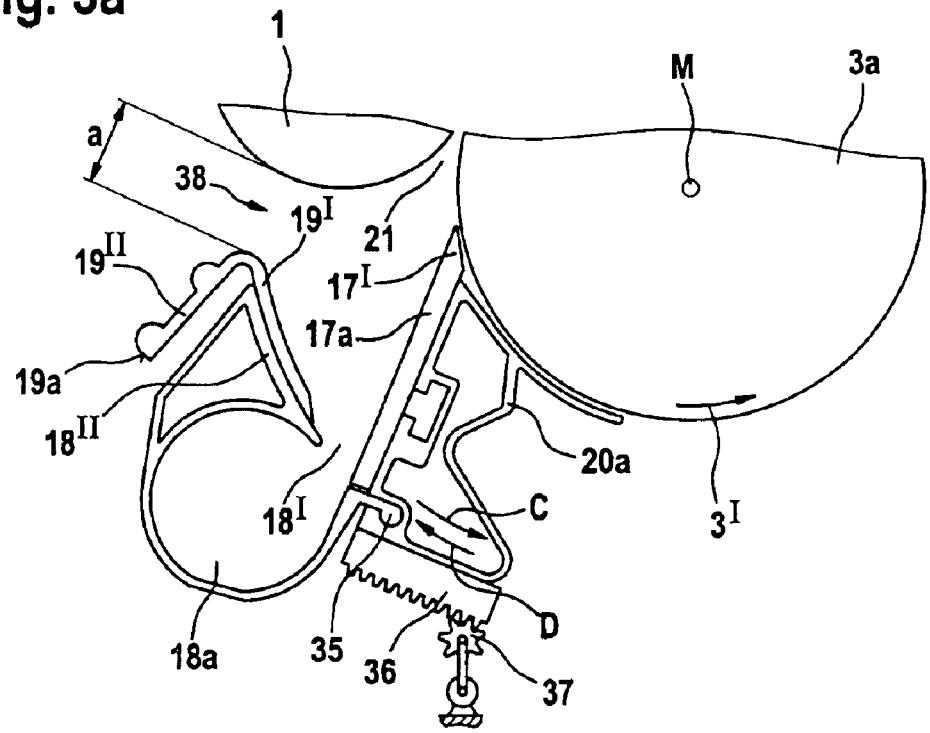
FIGS. 3*a*, 3*b* show the device according to the invention in positions with a narrow cleaning gap (FIG. 3*a*) and with a wide cleaning gap (FIG. 3*b*).
Figure 3B:
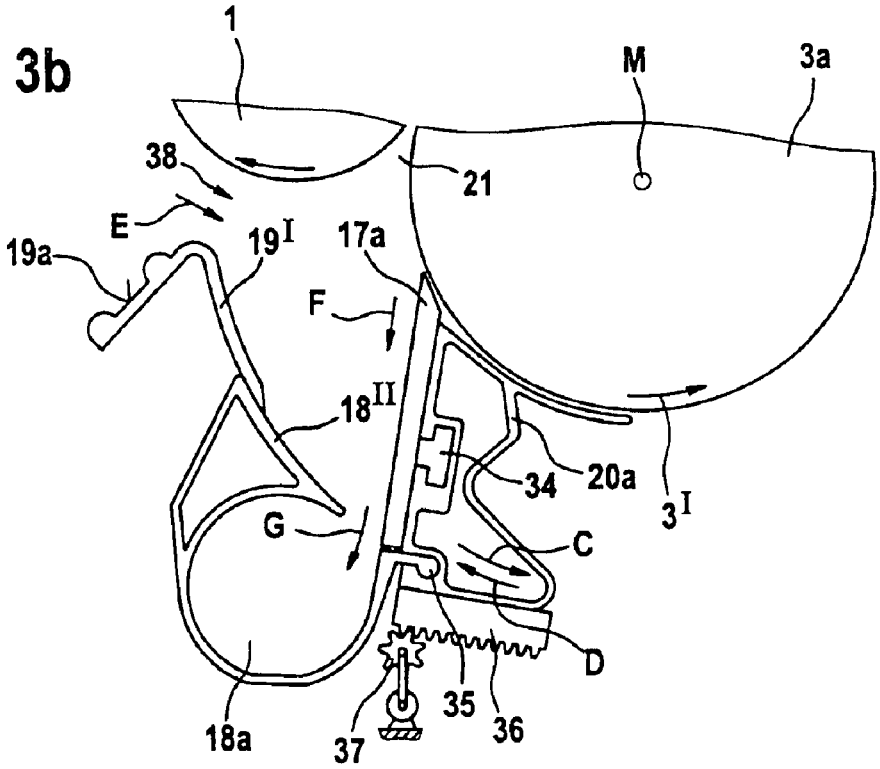

With reference to FIGS. 3*a*, 3*b*, the licker-in or roller 3*a* of the carding machine of FIG. 1 is associated with the separating blade 17*a* for impurities F, which blade is arranged on a support 20*a*. The edge 17' of the separating blade 17*a* is opposed to the direction of rotation 3' of the licker-in 3*a*. The support 20*a*, for example an extruded aluminum profile, is displaceable in the direction of arrows C and D parallel to the outer surface of the licker-in 3*a*, i.e. concentric with the centre point M of the licker-in 3*a*. Reference numeral 21 denotes the separation opening which is located between the separating blade 17*a* and the feed roller 1. The feed roller 1 is in a fixed position in that, at least during operation, the roller axis is in a fixed position. Because the support 20*a* is displaceable in directions C, D, the distance between the separating blade 17*a* and the slow-speed feed roller 1 bordering the separation opening 21 can be varied. The separating blade 17*a* is mounted on the support 20*a* by means of a screw connection 34 or the like so as to be displaceable in the direction of the licker-in 3*a*. The separating blade 17*a* is associated with the extraction hood 18*a*, which is mounted in a pivot bearing 35 on the support 20*a*. Reference numeral 18' denotes the inlet opening into the extraction hood 18*a*, which opening extends in slot-like manner across the width of the machine or the extraction hood 18*a*. On the extraction hood 18*a* there is mounted—opposite the support 20*a*—in the region of the intake slot 18' a guiding member 18" in the form of a guide sheet 18". The free end of the guide sheet is directed towards the intake slot 18'. The guiding element 18", which together with the extraction hood 18*a* forms an integrally extruded component, has a slightly curved shape. The extraction chamber 18*a* is associated with a guide element 19*a*, which is in a fixed position during operation, and is located in the region underneath the separation opening 21. The guide element 19*a* is somewhat angular in shape and has a slightly curved arm 19', the free end of which points towards the intake opening 18'. The other end of the arm 19' is rounded and merges into a holding and securing element 19" for the guide element 19*a*. The distance a between the rounded portion and the feed roller 1, which denotes an air-inlet opening 38 for an air current E, is constant during operation. The guiding member 18" is arranged on the side of the arm 19' remote from the licker-in 3*a*. The displacement of the support 20*a* is effected by a rack 36 with a pinion 37. Whilst it is in a fixed position during operation, the position of the guide element 19*a* and thus the distance a can be adjusted by means of an adjusting device (not shown) when the carding machine is not operating.

When the support 20*a* is displaced in the direction of arrow C, the separating blade 17*a* and the extraction hood 18*a* are displaced from the position according to FIG. 3*a* into the position according to FIG. 3*b*. At the same time, the guiding member 18" is also displaced in direction C. As a result of the displacement of the separating blade 17*a*, the separation opening 21 is enlarged so that more impurities F are separated from the fibre material. The guiding member 18" is displaced concentrically with respect to the arm 19'. The width of the air-inlet opening 38 and of the intake slot 18' remain constant even when the support 20*a* is displaced, so that when the separation opening 21 is altered the size of the incoming air current E and the size of the extracted air current G remain the same. A further advantage is that for any size of the separation opening 21 the separated impurities F always fall onto the arm 19' and/or onto the guiding member 18" and are reliably guided through the extraction slot 18' into the extraction chamber 18*a*.

The fixed-position guide element 19*a* cooperates with the guiding element 18" on the lines of a nested arrangement. The guiding member 18" may cooperate in sliding fashion with arm 19' of guide element 19*a*. Displacement of the support 20*a* in the direction of arrows C and D results in a narrow cleaning gap (FIG. 3*a*) and a wide cleaning gap (FIG. 3*b*), respectively.

In FIGS. 3*a*, 3*b* the invention has been described using the example of a device underneath a high-speed roller, e.g. licker-in 3*a*. The device according to the invention can be arranged in accordance with FIG. 2 also above or below a high-speed roller of a cleaner, e.g. the rollers 24 and 26. The extraction hoods 18*b*, 18*c* of FIG. 1 may be of similar construction to that described in FIGS. 3*a*, 3*b*, with reference to extraction hood 19*a* of FIG. 1. In that case, however, the guide elements 19*b*, 19*c*, will cooperate with a counter-surface other than feed roller 1.

Reference letter K denotes an air current which according to FIG. 2 detaches fibre flocks from the last roller 26 of the cleaner, the fibre flocks being extracted in accordance with arrow L.

What is claimed is:

1. A device on a spinning preparatory machine having at least one separating blade which is associated with a roller and co-operates with a fixed-position counter element to define a separation opening for impurities, wherein the separating blade is arranged on a support which is displaceable substantially parallel to the periphery of the roller for adjusting the distance between the separating blade and the fixed-position counter-element, the device further comprises an extraction chamber which is mounted on the support, and the extraction chamber co-operates with a guide element, the guide element being arranged to be in a fixed position during operation of the machine and being able to guide separated impurities and/or air into the opening of the extraction chamber.

2. A waste removal device for a spinning preparatory machine comprising a separating blade mounted on a support, said support being displaceable with said separating blade for size adjustment of a separating opening at a roller of the spinning preparatory machine, said device further comprising an extraction chamber mounted on said support having an extraction chamber inlet and a guide element in cooperating relationship with said extraction chamber for guiding separated waste into said extraction chamber inlet.

3. A waste removal device according to claim 2, comprising a counter-element arranged in a fixed position and defining with said guide element an opening which is of substantially constant size during operation.

4. A waste removal device according to claim 3, in which the size of the opening can be adjusted.

5. A waste removal device according to claim 2, in which the guide element includes a curved guide surface.

6. A waste removal device according to claim 2, in which the guide element has a free end, the free end be in co-operating relationship with the extraction chamber.

7. A waste removal device according to claim 6, in which said free end is of decreasing thickness.

8. A waste removal device according to claim 2, in which the extraction chamber is provided with a guiding member which cooperates with the guide element.

9. A waste removal device according to claim 8, in which the guiding member is displaceable with respect to the guide element.

10. A waste removal device according to claim 8, in which the rear surface of the guide element and a guiding surface of the guiding member are curved and have substantially the same radius of curvature, said guiding member being displaceable in a substantially parallel direction relative to said guide element.

11. A waste removal device according to claim 8, in which at least a part of the guide element and at least a guide surface of the guiding member can be brought into nesting relationship with one another.

12. A waste removal device according to claim 2, having a counter-surface which, in cooperation with the guide element defines an air intake opening for intake of air, the air intake opening being in communication with an inlet in the extraction device for receiving waste from the separation opening.

13. A waste removal device according to claim 2, in which said guide element is stationary at least during operation of the spinning preparatory machine.

14. A method for removing impurities from a spinning preparatory machine having a separating blade associated with a roller, said separating blade co-operating with a fixed-position counter element to define a separation opening for the passage of impurities, the method comprising:

displacing said separating blade in a direction substantially parallel to the periphery of said roller;

said displacement adjusting the distance between the separating blade and the fixed-position counter-element;

separating impurities using said separating blade; and guiding the separated impurities into an opening of an extraction chamber.

15. A waste removal device for a spinning preparatory machine comprising:

a first roller;

a second roller rotatable about a central axis;

a support rotatable about said central axis and displaceable substantially parallel to a surface of said second roller;

a separating blade affixed to said support, displacement of said support adjusting the size of a separation opening between said first roller and said separating blade;

an extraction chamber mounted on said support, said extraction chamber having an inlet for receiving separated waste; and a guide element for guiding waste into the inlet of said extraction chamber.

16. A waste removal device according to claim 15, having an opening between said first roller and said guide element, said opening being of substantially constant size during displacement of said support.

17. A waste removal device according to claim 16, wherein the size of said opening is adjustable.

18. A waste removal device according to claim 15, wherein said guide element and said extraction chamber are moveable relative to each other.

19. A waste removal device according to claim 15, wherein said guide element is stationary during operation of the spinning preparatory machine.

20. An apparatus for removing impurities from a spinning preparatory machine having a separating blade associated with a roller, said separating blade co-operating with a fixed-position counter element to define a separation opening for the passage of impurities, said roller rotatable about a central axis, the apparatus comprising:

means for displacing said separating blade around said central axis of said roller in a direction substantially parallel to the surface of said roller, means for separating impurities using said separating blade; and means for guiding the separated impurities into an opening of an extraction chamber.

* * * * *